US007407160B2

(12) United States Patent
Peulen et al.

(10) Patent No.: US 7,407,160 B2
(45) Date of Patent: Aug. 5, 2008

(54) DISCHARGE SYSTEM FOR PRINTED SHEETS

(75) Inventors: Johannes E. P. Peulen, Belfeld (NL); Hendrikus J. J. Van Soest, Helden (NL)

(73) Assignee: Oce-Technologies B.V., Venlo (NL)

( * ) Notice: Subject to any disclaimer, the term of this patent is extended or adjusted under 35 U.S.C. 154(b) by 433 days.

(21) Appl. No.: 11/285,349

(22) Filed: Nov. 23, 2005

(65) Prior Publication Data

US 2006/0181019 A1 Aug. 17, 2006

(30) Foreign Application Priority Data

Nov. 25, 2004 (EP) ..... 04106080

(51) Int. Cl.
*B65H 3/06* (2006.01)

(52) U.S. Cl. ..... 271/207; 271/198; 271/272; 271/273; 271/314; 347/104; 399/405; 399/406

(58) Field of Classification Search ..... 271/198, 271/207, 314, 272, 273; 347/104; 399/405, 399/406

See application file for complete search history.

(56) References Cited

U.S. PATENT DOCUMENTS

| | | | | | |
|---|---|---|---|---|---|
| 3,840,224 | A | * | 10/1974 | Zawiski | 271/263 |
| 3,948,505 | A | | 4/1976 | Miller et al. | |
| 4,648,587 | A | * | 3/1987 | Hiromori et al. | 271/12 |
| 4,824,091 | A | | 4/1989 | Knight | |
| 4,842,263 | A | * | 6/1989 | Robertson | 271/186 |
| 4,884,798 | A | * | 12/1989 | Vermaat | 271/307 |
| 4,988,087 | A | * | 1/1991 | Sardano et al. | 271/314 |
| 5,215,300 | A | * | 6/1993 | Hiroi et al. | 271/176 |
| 5,401,540 | A | * | 3/1995 | Miles et al. | 427/256 |
| 5,709,376 | A | | 1/1998 | Ushirogata | |
| 6,145,833 | A | * | 11/2000 | Rodewald et al. | 271/182 |
| 6,216,591 | B1 | * | 4/2001 | Nanba | 101/232 |
| 6,264,194 | B1 | * | 7/2001 | Hayashi et al. | 271/220 |
| 6,603,954 | B1 | * | 8/2003 | Zoltner et al. | 399/405 |
| 6,623,003 | B1 | * | 9/2003 | Koizumi et al. | 271/270 |
| 7,107,004 | B2 | * | 9/2006 | Saito | 399/405 |
| 2004/0113359 | A1 | | 6/2004 | Hostettler | |

FOREIGN PATENT DOCUMENTS

| | | |
|---|---|---|
| EP | 0 407 151 A2 | 1/1991 |
| EP | 0 407 152 A2 | 1/1991 |
| JP | 08-002775 A | 1/1996 |

* cited by examiner

*Primary Examiner*—Patrick Mackey
*Assistant Examiner*—Prasad V Gokhale
(74) *Attorney, Agent, or Firm*—Birch, Stewart, Kolasch & Birch, LLP.

(57) ABSTRACT

A discharge system for printed media sheets and a printer which utilizes such a discharge system, the discharge system including a tray for the media sheets; rotating transport elements forming a discharge nip for discharging the sheets onto the tray; a guide plate having a surface for guiding the sheets to the discharge nip; and a rotating wheel containing bristles for guiding the sheets towards the discharge nip; the wheel facing said surface of the guide plate. At least one driven transport belt forms one of the transport elements defining the discharge nip, and the guide plate passes in approximately a one-half turn around two pulleys around which the transport belt is passed.

7 Claims, 2 Drawing Sheets

DISCHARGE SYSTEM FOR PRINTED SHEETS

BACKGROUND OF THE INVENTION

The present invention relates to a discharge system for printed media sheets, including: a tray for the media sheets; rotating transport elements forming a discharge nip for discharging the sheets onto the tray; a guide plate having a surface for guiding the sheets to the discharge nip; and a rotating wheel containing bristles for guiding the sheets towards the discharge nip.

In printers and copiers, printed media sheets are frequently collected on one or more trays. The media sheets may be supplied, for example, from a stack of cut sheets, or may be continuously supplied from a reel and then cut into sheets. When the media sheets are supplied from a reel, they are often slightly curled. This effect becomes even more pronounced when the end of the coil on the reel is reached and the radius of curvature of the reel becomes smaller. But also when the media sheets are supplied from a stack of cut sheets, they may become curled during the printing process.

When the sheets are guided along the surface of the guide plate towards the discharge nip, in case of a curled sheet, a part of the sheet may stick out from the guide plate. This might prevent the leading edge of the sheet from being properly threaded to the discharge nip, possibly resulting in the sheet becoming folded. This danger cannot be avoided by an arrangement ensuring that the transport elements immediately engage a sheet when it is fed to the discharge system, for the following reasons. In case the sheet has been printed with ink, the ink might not be completely dry when the sheet is fed to the discharge system, so that the printed image might get blurred. Moreover, the configuration of the discharge system may require a certain length of the guide plate. For example, in a printer the tray may be positioned above the printing unit, and a curved guide plate is needed to reverse the sheet transport direction before the sheet is discharged onto the tray.

JP 08002775 A shows a paper discharge device in which a brush roller is arranged in the way of the leading edge of a sheet. Depending on the rotational direction of the brush roller, the brush roller guides the sheet to a paper through direction or to a paper discharge direction. In the latter case, the sheet is guided between the brush roller and a guiding surface which is curved away from the brush roller, and is then funneled through a space between the guiding surface and an opposing guiding surface towards the discharge rollers. However, a curled sheet might curl around the brush roller instead of being funneled towards the discharge rollers. Moreover, the paper discharge device is suitable only for dry sheets, because the sheet is conveyed between pairs of conveying rollers towards the brush roller, and because any surface of the sheet may be guided to a side of the brush roller where it gets into a sliding contact with an opposing wall.

From EP 0 407 151 A2, a similar sheet path selector with a bidirectionally rotatable brush wheel is known.

EP 0 407 152 A2 shows a sheet stacker in which fiber brushes and foam drive rolls are arranged on a rotatable drive shaft. The diameter of the fiber brushes is greater than that of the foam drive rolls, so that the fiber brushes urge a leading edge of a sheet being fed vertically downward toward a nip being formed between the foam drive rolls and a baffle which is bent away from the foam drive rolls. However, both sides of the sheet are in sliding contact with walls that guide the sheet towards the fiber brushes, so that the sheet stacker can only be used for dry sheets.

U.S. Pat. No. 4,824,091 A shows a sheet collection device in which a sheet is guided between opposing straight walls to a discharge opening, while the sheet is engaged between two nip rollers. Rotatable brushes are arranged at the discharge opening to wipe down against a trail end of a sheet that has been discharged onto a tray. The brushes are arrange coaxially with one of the nip rollers and force a leading edge of a sheet against the opposing wall and into engagement with the nip rollers. However, the brushes do not assist in threading the sheet into the entrance aperture between the opposing walls, so that a curled sheet might get folded there.

SUMMARY OF THE INVENTION

It is an object of the present invention to provide a discharge system that ensures that curled media sheets are properly fed to a discharge nip. It is also an object of the present invention to provide a printer containing such discharge system.

According to the present invention, this object is achieved by a discharge system of the type wherein at least one driven transport belt forms one of the transport elements defining the discharge nip; a guide plate passes approximately one-half turn around two pulleys around which the transport belt is passed; a wheel is provided which faces the surface of the guide plate; the transport belt being arranged to guide the sheets towards the discharge nip and the wheel being arranged to guide the sheets to the transport belt. The wheel may also be configured as a drum extending essentially over the entire width of the guide plate.

When a sheet is guided along the guide plate, the wheel is situated on a first side of the sheet, where the image has been printed, and the guide plate is situated on the other side of the sheet. There may be free space between the wheel and the guide plate, so that a sheet that is only moderately curled may be guided by the guide plate without contacting the wheel. However, a sheet that is significantly curled will be confined in the space between the wheel and the guide plate. The bristles only touch the sheet at small points, so that the printed image on the sheet is not damaged in case the ink has not completely dried. Preferably, the bristles are radial bristles.

Preferably, the wheel is laterally offset from one of the transport elements defining the discharge nip and partially intersects the cross-section of said transport element. Thereby, an edge or an area of the sheet that is in contact with and guided by the wheel will be conveyed to the transport elements.

In one embodiment, the guide plate is curved and passes in approximately a one-half turn around the wheel. Thereby, the guide plane turns over the sheet and reverses the transport direction of the sheet. In this case, guidance of the sheet is specifically needed to avoid that the sheet becomes folded and the transport elements become jammed.

Preferably, the bristles are arranged in bunches distributed over the circumference of the wheel and the bunches are staggered in at least two rows. A wheel with bunches is easier to manufacture than a wheel with evenly distributed singulated bristles. Further, due to the staggering of the bunches, the bristles are uniformly distributed over the circumference of the wheel.

Preferably, the bristles are made of plastic, in particular nylon. It has been found that nylon bristles are especially advantageous in that damage to a printed image is avoided even when the ink has not dried completely.

Preferably, the wheel is arranged coaxially to one of the pulleys; the bristles extending further than the diameter of said pulley. Thereby, a curled part of the sheet that is being moved towards the pulley is prevented from hitting the transport belt where it is curved around the pulley. Instead, the curled part of the sheet is guided by the bristles to a straight part of the transport belt. Thereby, a damaging of a printed surface of the sheet is avoided.

BRIEF DESCRIPTION OF THE DRAWINGS

A preferred embodiment of the present invention will now be described in conjunction with the drawings in which.

DETAILED DESCRIPTION OF THE INVENTION

Figure 1:
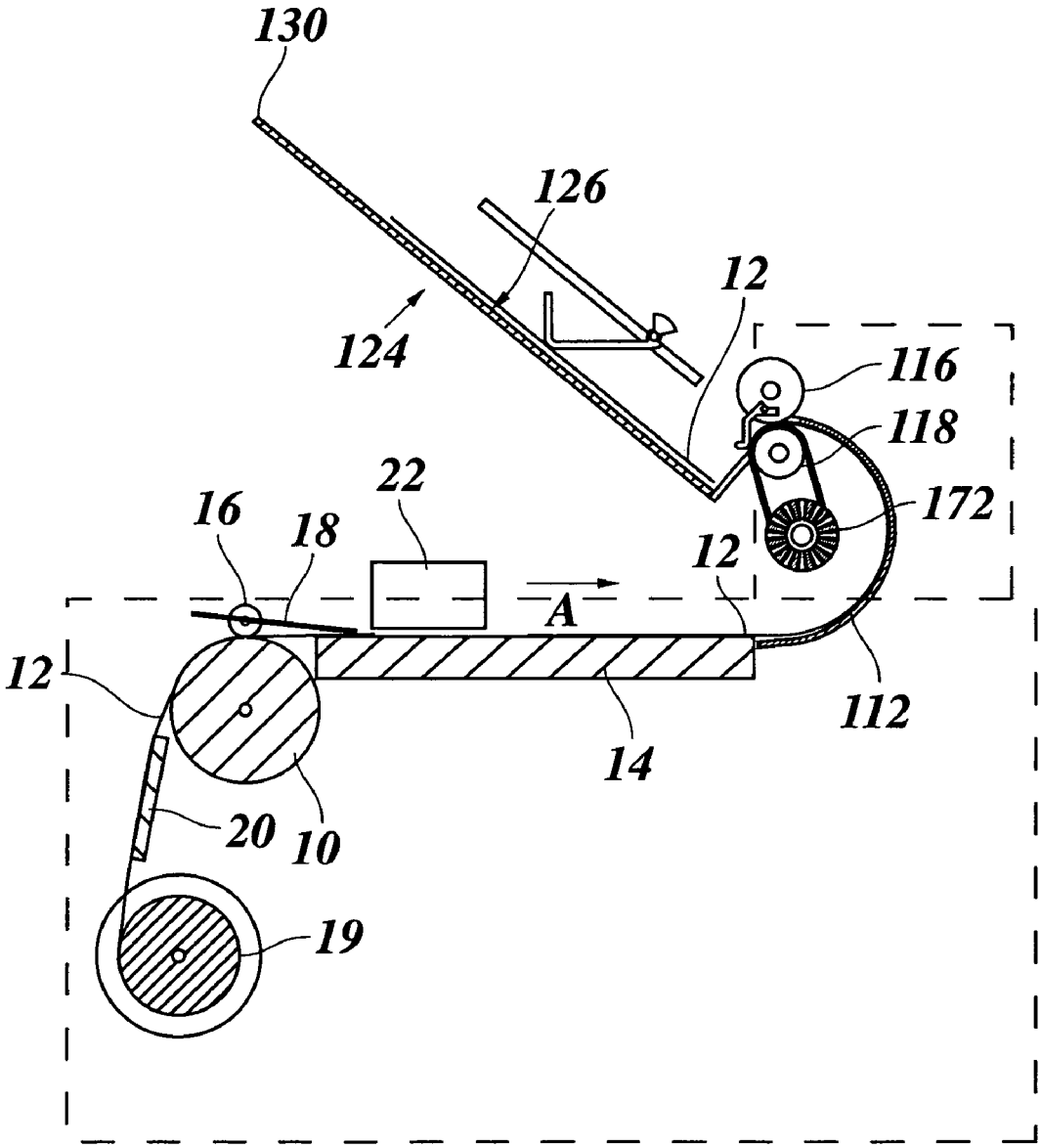
FIG. 1 is a schematic partial cross-sectional view of a printer.

As is shown in FIG. 1, an ink jet printer comprises a platen 10 which is intermittently driven to rotate in order to advance a sheet 12, e.g. a sheet of paper, in a direction indicated by an arrow A over the top surface of a sheet support plate 14. A number of transport rollers 16 are rotatably supported in a cover plate 18 and form a transport nip with the platen 10 so that the sheet 12, which is supplied from a reel 19 via a guide plate 20, is paid out through a gap formed between an edge of the cover plate 18 and the surface of the sheet support plate 14.

A carriage 22 which includes a number of ink jet print heads (not shown) is mounted above the sheet support plate 14 so as to reciprocate in a direction that is perpendicular to the plane of the drawing across the sheet 12. In each pass of the carriage 22, a number of pixel lines are printed on the sheet 12 by means of the print heads which eject droplets of ink onto the sheet in accordance with image information supplied to the print heads. For the sake of simplicity, guide and drive means for the carriage 22, ink supply lines and data supply lines for the print heads, and the like, have not been shown in the drawing.

The top surface of the sheet support plate 14 has a regular pattern of suction holes (not shown) through which the sheet 12 is drawn against the flat surface of the support plate 14 and is thereby held in a flat condition, especially in the area which is scanned by the carriage 22, so that a uniform distance between the nozzles of the printheads and the surface of the sheet 12 is established over the whole width of the sheet and a high print quality can be achieved. The sheet 12 is further advanced along a surface 111 of a curved guide plate 112 that turns the sheet upside down and reverses the transport direction of the sheet 12.

Figure 2:
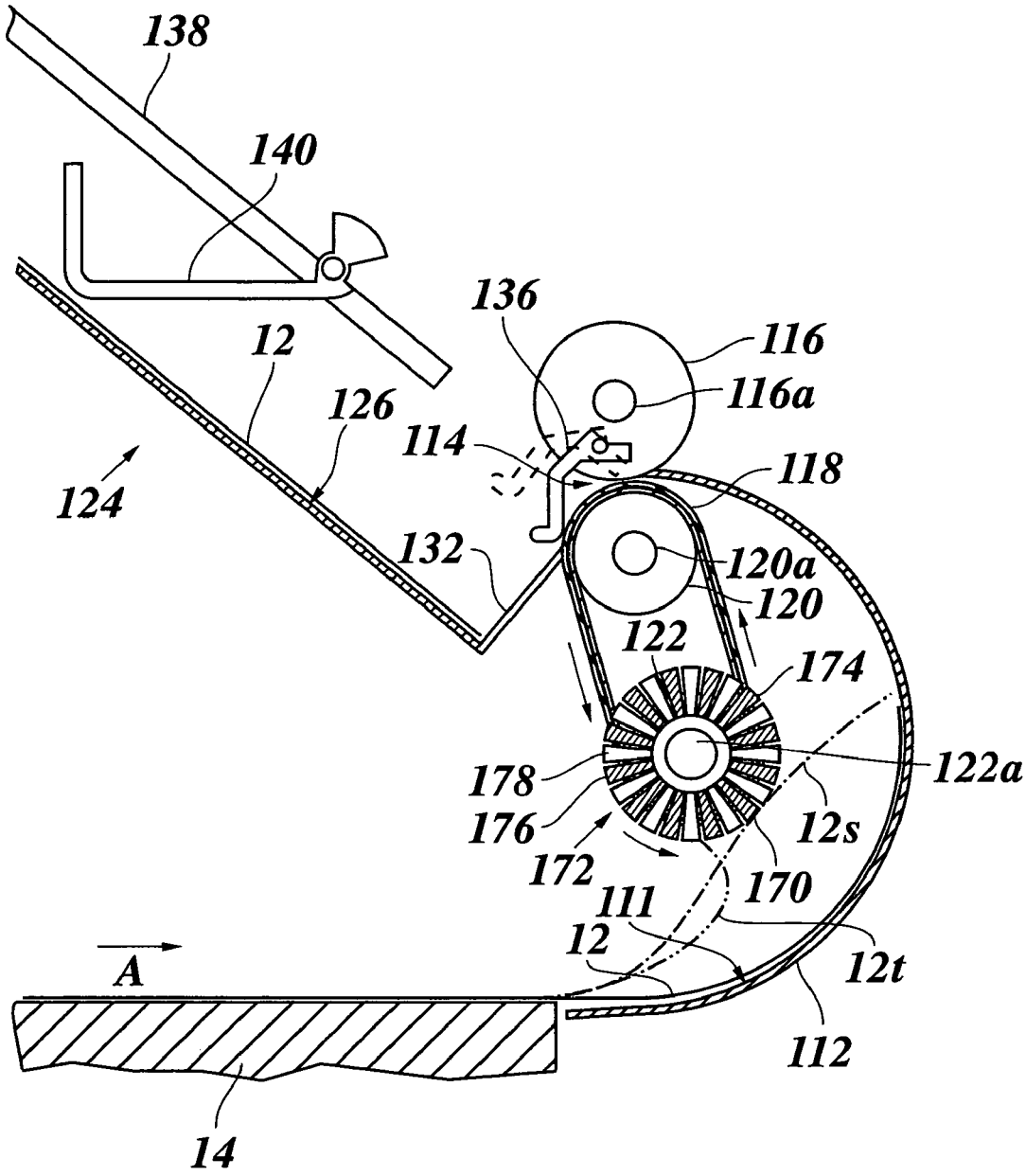
FIG. 2 shows details of a sheet discharge system of the printer shown in FIG. 1.

As is shown in FIG. 1 and, in more detailed view, in FIG. 2, the sheet 12 is then fed to a discharge nip 114 formed between a plurality of discharge rollers 116 and a plurality of rubber-coated transport belts 118 which are each passed around a pair of pulleys 120 and 122 (pulley 122 being not visible in FIG. 2). The direction of movement of the transport belts 118 is indicated by arrows. The discharge rollers 116 are mounted on a common axle 116*a*, and the pulleys 120 and 122 are also mounted on common axles 120*a* and 122*a*, respectively. From the discharge nip 114, the sheet 12 is discharged onto a tray 124. The tray 124 has a top surface 126 for supporting the sheets and has stops 132 at which the trailing edges of the sheets 12 will be aligned.

A discharge sensor 136 is arranged near the discharge nip 114 to indicate when the trailing edge of the sheet 12 has been discharged from the discharge nip 114. The discharge sensor 136 is of conventional design and includes an arm that is pivotable about an axis.

A top frame member 138 of the tray 124 carries a tray-full sensor 140 which is also of conventional design comprising an arm that is pivotably mounted on the frame member 138.

So far, the transport of the sheet 12 along the surface 111 of the guide plate 112 has been described. However, when the sheet is supplied from the reel 19 (FIG. 1), it may curl after it has left the sheet support plate 14. A curled sheet 12*s* is indicated in a chain-dotted line in FIG. 2. The sheet 12*s* forms a hump 170 that sticks out from the guide plate 112.

The hump 170 is guided by a wheel 172 comprising radial bunches of bristles 174. The bunches are alternately arranged in two circumferential rows 176, 178 which are laterally offset from one another. In FIG. 2, the bunches of a first row 176 of bunches are hatched and lie within the plane of the drawing. The bunches of a second row 178 of bunches are plainly drawn and lie behind the plane of the drawing.

The wheel 172 is arranged on the axle 122*a* and rotates together with the pulley 122 in a direction that is indicated by an arrow in FIG. 2. The bristles 174 contact the hump 170 of the sheet 12*s* and thereby guide the sheet 12*s* without damaging the printed surface of the sheet 12*s*. Thus, it is avoided that the leading edge of the sheet 12*s* is folded back, as might be the case if the wheel 172 and the pulley 122 were not present.

The discharge system of FIG. 2 may also be used with a sheet that is curled even stronger. Such a sheet 12*t* is also indicated in FIG. 2. In this case, the leading edge of the sheet 12*t* comes into contact with the wheel 172 and is guided in the direction that is indicated by an arrow. When the leading edge of the sheet 12*t* is transported along the wheel 172, the wheel 172 will contact with the printed surface of the sheet 12*t*. Again, a damaging of the printed surface is avoided.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A discharge system for printed media sheets, comprising:

a tray for receiving the media sheets;

rotating transport elements provided at said tray forming a discharge nip for discharging the sheets onto the tray; a guide plate having a surface for guiding the sheets to the discharge nip; and a rotating wheel containing bristles for guiding the sheets towards the discharge nip wherein at least one driven transport belt forms one of the transport elements defining the discharge nip; the guide plate passing in approximately one-half turn around two pulleys around which the transport belt passes; the wheel facing said surface of the guide plate; the transport belt being arranged to guide the sheets towards the discharge nip and the wheel being arranged to guide the sheets to the transport belt.

2. The discharge system of claim 1, wherein the wheel is laterally offset from one of the transport elements defining the discharge nip and partially intersects a cross-section of said transport element.

3. The discharge system of claim 1, wherein the guide plate is curved and passes in approximately one-half turn around the wheel.

4. The discharge system of claim 1, wherein the bristles are arranged in bunches distributed over the circumference of the wheel, the bunches being staggered in at least two rows.

5. The discharge system of claim 1, wherein the bristles are made of nylon.

6. The discharge system of claim 1, wherein the wheel is arranged coaxial to one of the pulleys; and the bristles extend further than the diameter of the pulley.

7. A printer containing a sheet discharge system according to claim 1.

* * * * *